US008978850B2

(12) United States Patent
Bettua et al.

(10) Patent No.: US 8,978,850 B2
(45) Date of Patent: Mar. 17, 2015

(54) RECONFIGURABLE BAG

(75) Inventors: Michael Bettua, Hoboken, NJ (US); Kiran Joseph, Chennai (IN)

(73) Assignee: Max Mirani Investments, LLC, New York, NY (US)

( * ) Notice: Subject to any disclaimer, the term of this patent is extended or adjusted under 35 U.S.C. 154(b) by 29 days.

(21) Appl. No.: 13/703,314

(22) PCT Filed: Jun. 10, 2011

(86) PCT No.: PCT/US2011/040067

§ 371 (c)(1), (2), (4) Date: Dec. 10, 2012

(87) PCT Pub. No.: WO2011/156770

PCT Pub. Date: Dec. 15, 2011

(65) Prior Publication Data

US 2013/0087423 A1 Apr. 11, 2013

Related U.S. Application Data

(60) Provisional application No. 61/354,008, filed on Jun. 11, 2010.

(51) Int. Cl.
*A45C 7/00* (2006.01)
*A45C 3/00* (2006.01)

(52) U.S. Cl.
CPC ..... *A45C 7/009* (2013.01); *A45C 7/0068* (2013.01); *A45C 7/0077* (2013.01); *A45C 2003/007* (2013.01); *A45C 2003/008* (2013.01)
USPC ..... 190/103; 190/105; 190/107; 383/2; 383/4

(58) Field of Classification Search
CPC ..... A45C 7/009
USPC ..... 190/103, 106, 107, 105; 383/2, 4, 33; 150/127, 900
See application file for complete search history.

(56) References Cited

U.S. PATENT DOCUMENTS

| | | | | | |
|---|---|---|---|---|---|
| 1,636,838 | A | * | 7/1927 | Roser | 190/103 |
| 2,018,809 | A | * | 10/1935 | Rodgers | 190/103 |
| 2,927,617 | A | * | 3/1960 | Kurzrock | 383/2 |
| 3,587,795 | A | | 6/1971 | Berry et al. | |
| RE27,456 | E | * | 8/1972 | Dyke | 166/252.1 |
| 4,128,150 | A | * | 12/1978 | Popkin et al. | 190/103 |
| 4,244,408 | A | * | 1/1981 | Shoda | 383/2 |
| 4,334,601 | A | | 6/1982 | Davis | |
| 4,685,546 | A | | 8/1987 | Sadow | |

(Continued)

FOREIGN PATENT DOCUMENTS

| | | | |
|---|---|---|---|
| EP | 0288651 | A1 * | 2/1988 |
| JP | 58082112 | | 3/1983 |

(Continued)

OTHER PUBLICATIONS

International Search Report for PCT/US2011/040067 dated Feb. 22, 2012.

*Primary Examiner* — Sue A Weaver
(74) *Attorney, Agent, or Firm* — PatentBest; Andrew McAleavey

(57) ABSTRACT

A reconfigurable bag is disclosed. The reconfigurable bag has a center expanding section and two bottom expanding sections, all of which may be moved between stored and open configurations. Opening one or more of the expanding sections changes the shape and configuration of the bag.

18 Claims, 14 Drawing Sheets

(56) References Cited

U.S. PATENT DOCUMENTS

| | | | | |
|---|---|---|---|---|
| 4,773,515 | A | 9/1988 | Kotkins, Jr. | |
| 5,143,188 | A | 9/1992 | Robinet | |
| 5,211,716 | A | 5/1993 | Tobias | |
| 5,307,908 | A | 5/1994 | Shyr et al. | |
| 5,542,767 | A | 8/1996 | Hedaya et al. | |
| 6,053,382 | A | 4/2000 | Wyant | |
| 6,179,101 | B1 | 1/2001 | Lin | |
| D444,298 | S | 7/2001 | Starck | |
| D444,945 | S | 7/2001 | Starck | |
| 6,591,950 | B1 | 7/2003 | Scicluna | |
| 6,609,598 | B2 | 8/2003 | Hsu | |
| 8,459,489 | B2 * | 6/2013 | Potts et al. | 220/553 |
| 2006/0102673 | A1 | 5/2006 | Collier | |
| 2007/0045071 | A1 | 3/2007 | Gorga | |
| 2009/0032348 | A1 | 2/2009 | Wang | |

FOREIGN PATENT DOCUMENTS

| | | |
|---|---|---|
| JP | 61102123 | 12/1984 |
| JP | 10229908 | 9/1998 |

* cited by examiner

RECONFIGURABLE BAG

TECHNICAL FIELD

In general, the invention relates to luggage, and particularly to bags with multiple configurations.

BACKGROUND OF THE INVENTION

Bags and other types of luggage are used to carry items and to store and protect possessions during travel. There are innumerable styles and sizes of bags and other forms of hand luggage available on the market, each one suited for a slightly different purpose. In selecting a bag for a particular task, two problems arise. First, it can be difficult to decide what size of bag to use. If one chooses too small a bag for a particular task, there is a chance that one will not be able to fit all that he or she would have liked into that bag. Choosing a bigger bag makes it more likely that one will be able to accommodate all of the items that he or she wishes to carry; however, large bags can be cumbersome and difficult to carry.

Second, it is generally desirable to choose a type of bag that suits the items that are to be carried. For example, duffel bags, which are cylindrical or rectilinear cloth bags with hand straps, are often used to carry clothes and possessions, but they may not be the most appropriate bag for smaller items. Moreover, the elongate cylindrical or rectilinear shape of the duffel bag may make it overly bulky and cumbersome in some situations.

One partial solution to the problems noted above is to use an expandable bag, and a number of expandable bags are known. For example, U.S. Pat. No. 4,773,515 to Kotkins, Jr. discloses a duffel bag with a bellows-like expanding joint on each end. A similar bellows-type expansion is found in the typical valise, exemplified by U.S. Pat. No. 5,211,716 to Tobias. However, in each of these two cases, the configuration of the bag does not change; it is merely capable of expanding somewhat in size.

By contrast, commonly-assigned U.S. Pat. No. 7,500,547 discloses a piece of hard-sided wheeled luggage in which the cover of the piece of luggage acts as an expansion panel, allowing the volume of the luggage to increase in order to accommodate additional articles. The luggage also includes features that allow it to collapse and fold when not in use, thus reducing the amount of space needed to store it. However, this type of expandable collapsing luggage is not intended to store articles while in the collapsed and folded configuration.

SUMMARY OF THE INVENTION

One aspect of the invention relates to a bag. The bag has first and second portions, each of which encloses a portion of the bag's storage volume, an expanding section, and left and right bottom expanding sections. The expanding section is comprised of a flexible material, and joins the first and second portions. The expanding section is capable of assuming either of two configurations: (1) a first configuration in which the expanding section is essentially folded or stuffed within the storage volume of the bag, and (2) a second configuration in which the expanding section forms a wedge- or sector-shaped section of the sides and bottom of the bag with the widest portion of the expanding section along the bottom of the bag, thereby expanding the storage volume of the bag and altering the angular position of the first and second portions with respect to one another. Each of the left and right bottom expanding sections comprises a wing panel hingedly connected to the bottom of the bag so as to pivot about a generally horizontal axis of rotation. A flexible wing material joins the wing panel with the bottom of the bag, and the wing panel and wing material together enclose an additional storage volume contiguous with the storage volume of the bag. The bottom expanding sections are capable of assuming either of two configurations: (1) a first configuration in which the flexible wing material is essentially stuffed or folded within the storage volume, and (2) a second configuration in which the flexible wing material forms a wedge- or sector-shaped section of the sides of the bag.

Another aspect of the invention also relates to a bag. The bag has a sidewall, a top, and a bottom defining a storage volume. The bag also includes at least one bottom expanding section. The bottom expanding section comprises a panel hingedly connected to the bottom of the bag so as to pivot about a generally horizontal axis of rotation. A flexible material joins the panel with the bottom of the bag such that the panel and the flexible material together enclose an additional storage volume contiguous with the storage volume of the bag. The bottom expanding section is capable of assuming either of two configurations: (1) a first configuration in which the panel is essentially flush with the bottom of the bag and the flexible material is essentially stuffed or folded within the storage volume, and (2) a second configuration in which the flexible material forms a wedge- or sector-shaped section of the sides of the bag.

Yet another aspect of the invention relates to a bag. The bag has a bottom, a pair of sidewalls, a pair of endwalls, and a top. The top is connected to the sidewalls and endwalls so as to cover and enclose the bag, and has a closeable opening. The bag also includes an expanding section extending from the top of one of the pair of sidewalls, across the bottom, and to the top of the other of the pair of sidewalls, and divides those panels. The expanding section is comprised of a flexible material that joins the divided panels and is capable of assuming either of two configurations: (1) a first configuration in which the expanding section is essentially folded or stuffed within the storage volume, and (2) a second configuration in which the expanding section forms a wedge- or sector-shaped section in the pair of sidewalls and the bottom.

These and other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which:

FIG. 14 is a sectional view illustrating two adjacent reinforced sections of fabric, with an unreinforced section in between.

DETAILED DESCRIPTION

Figure 1:
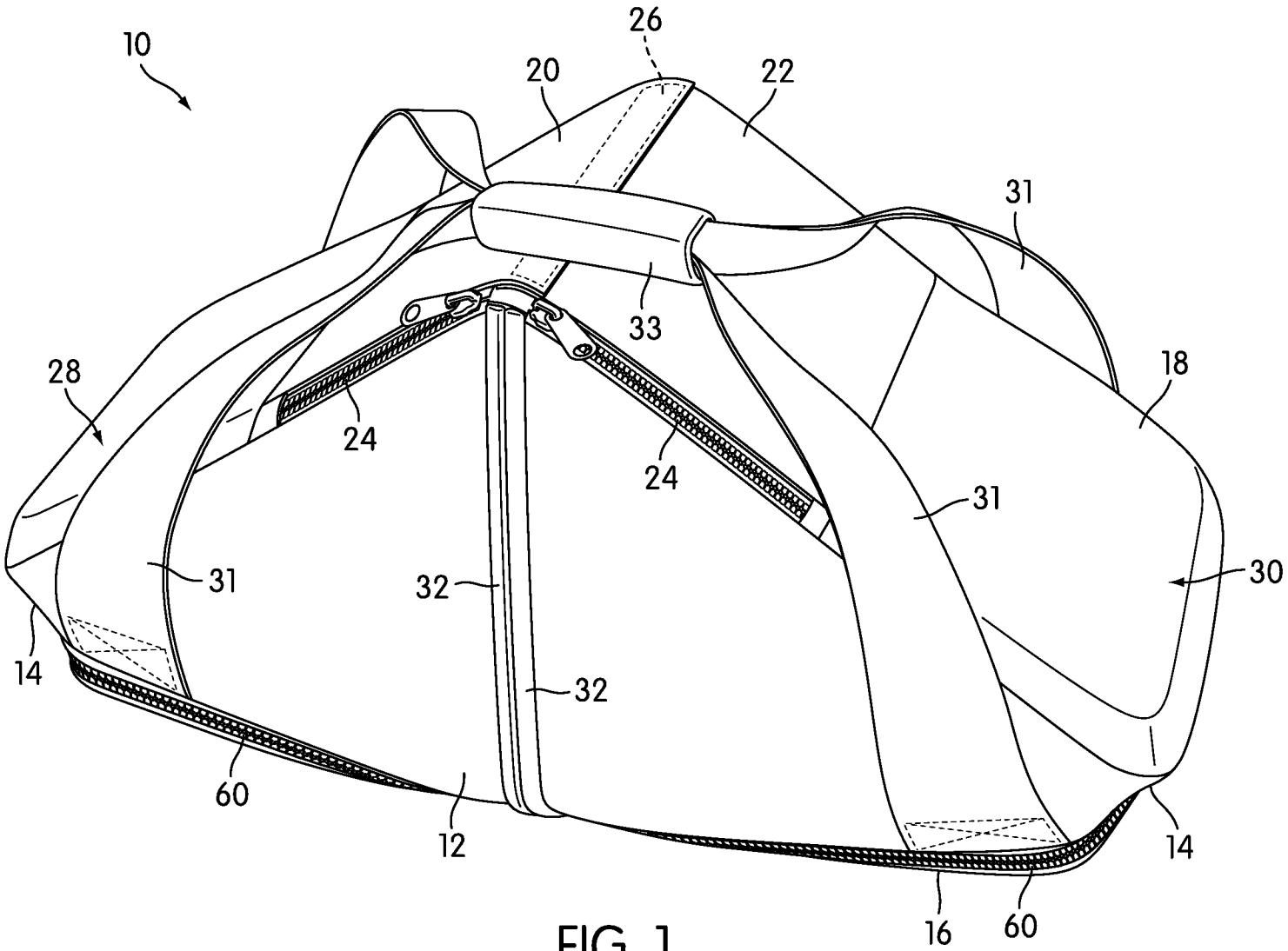
FIG. 1 is a perspective view of a bag according to one embodiment of the invention.

FIG. 1 is a perspective view of a bag, generally indicated at 10, according to one embodiment of the invention. As will be described below in more detail, the bag 10 is reconfigurable, in that a number of expansion sections allow the bag 10 to increase in internal volume, and also change the shape of the bag 10.

The bag 10 of FIG. 1 has a pair of sidewalls 12, a pair of end walls 14, a bottom 16 and a top 18. The sidewalls 12 and end walls 14 are connected to the bottom 16 and to one another along respective edges, such that they extend generally perpendicularly upward from the bottom 16 and enclose a storage volume. The top 18 is connected to the sidewalls 12 and end walls 14 along the top edges of those panels such that it covers and encloses the storage volume of the bag 10. The top 18 has two opening panels 20, 22 that open to provide access to the storage volume of the bag 10. The two opening panels 20, 22 are connected to the sidewalls 12 via two pairs of zippers 24, one pair on each side of the bag 10, and are held to one another by a releasable fastener, such as a strip of VELCRO® hook and loop fastener 26. (Although only one side of the bag 10 is visible in the view of FIG. 1, it should be understood that the other side is essentially a mirror image of the visible side.) In other embodiments, other means of access to the storage volume of the bag 10 may be used, as will be described below in more detail. Generally speaking, the way in which the storage volume of the bag 10 is accessed is not critical to the invention, so long as the bag 10 is easily opened and closed and the mechanism for doing so is reasonably durable.

In the illustrated embodiment, the shapes of the walls 12, 14, 16, 18 of the bag 10 give it the general shape of a pentagonal prism, with the sidewalls 12 having generally pentagonal shapes. However, bags according to embodiments of the invention may have any desired shape. Moreover, bags according to embodiments of the invention need not necessarily have discernible individual panels or walls; instead they may have a single, continuous, generally cylindrical sidewall, or one panel or wall may transition seamlessly into another. Some portions of this description may refer to the bag 10 as a "duffel" bag; when used, that term should be construed broadly to encompass any of these arrangements.

The bag 10 and its walls 12, 14, 16, 18 may be made of a variety of materials. In at least some embodiments of the invention, the major material of which the bag 10 is made would be a fabric, such as CORDURA® nylon or so-called "ballistic" nylon. Other suitable materials may include polyester, cotton canvas, leather, and polyurethane. In some embodiments, the interior of the bag 10 may be lined with a lining material, such as a microsuede or a high-sheen nylon, to name two options.

However, fabrics are not the only materials from which a bag 10 may be made. In some embodiments, polymers may be used, in either solid or foamed form. For example, the bag 10 may be made of ethylene-vinyl acetate (EVA) copolymer foam. Thermoplastic elastomers, such as thermoplastic urethanes, may also be used to construct the bag 10 or portions of it. Other thermoplastic polymers, such as polycarbonates, may also be used. In general, parts of the bag 10 may be injection molded, vacuum formed, or formed by any other process compatible with the materials that are used. For example, commonly-assigned U.S. Provisional Patent Application No. 61/295,155, filed Jan. 14, 2010, describes techniques for vacuum forming sheets of thermoplastic urethane (TPU) for luggage parts, and is incorporated by reference herein in its entirety.

Of course, the bag 10 need not be made of a single material; it may be made of multiple materials or of composite materials. Panels or walls of the bag 10 that are likely to see increased wear, such as the bottom 16, may be made of harder, wear- and impact-resistant materials if desired, such as acrylonitrile-butadiene-styrene (ABS) plastic, or of thicker sections of more flexible and less resistant materials. Materials such as polyethylene and polypropylene sheet material, polycarbonate sheet material, and carbon fiber sheeting may be used to reinforce the walls 12, 14, and bottom 16 as necessary or desired, depending on the particular application and operating conditions. In at least some embodiments, it may be advantageous if at least the walls 12, 14 and bottom 16 have enough rigidity to hold their own shape, but that need not be the case in all embodiments.

As shown, a pair of straps 31 are provided, one on each side of the bag 10, each strap 31 secured at the junction of the bottom 16 and sidewall 12 and further secured to the lower portion of the sidewall 12 in two places by box-and-cross stitching. The two straps 31 meet above the top panel 18 in a removable handle or grip 33. Instead of or in addition to stitching, the straps 31 could also be riveted, glued, thermally fused to the underlying fabric, or secured in some other fashion.

The bag 10 includes an expanding section that divides the storage volume of the bag 10 into left and right portions 28, 30 and joins those portions 28, 30 together. (Here, the terms "left" and "right" are used with respect to the coordinate system of the figures.) In the first configuration of the expanding section, shown in FIG. 1 and the bottom partial perspective view of FIG. 2, the expanding section is stored within the storage volume of the bag 10, such that only a set of piping 32 is visible on the exterior surface of the bag 10, extending vertically down one sidewall 12, across the bottom 16, and up the other sidewall 12. The piping 32, which is optional, conceals a fastener or fasteners that retain the expanding section in the first configuration. In the illustrated embodiment, the fastener is a zipper.

Figure 2:
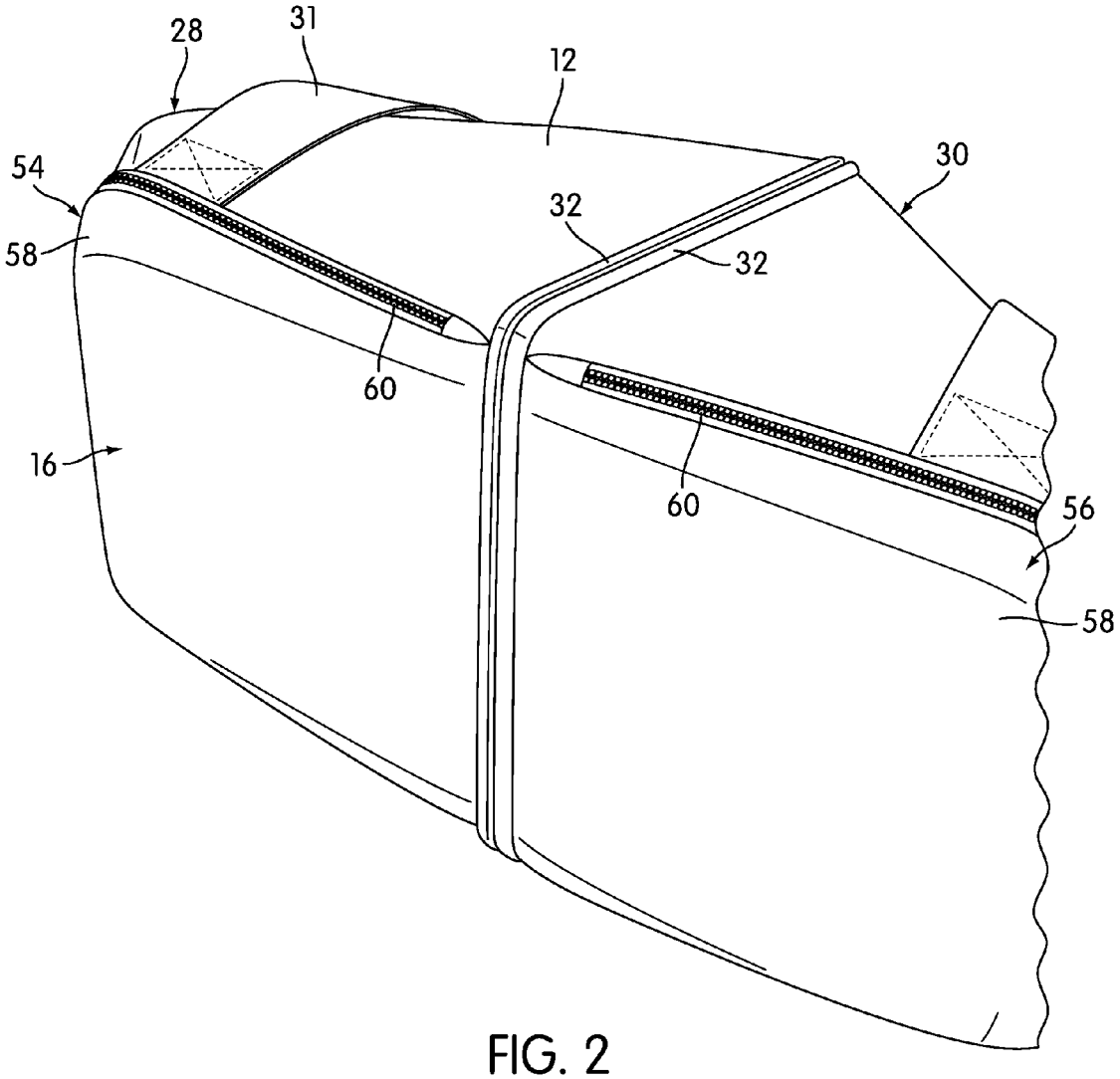
FIG. 2 is a partial perspective view of the bag of FIG. 1, illustrating the bottom of the bag.
Figure 3:
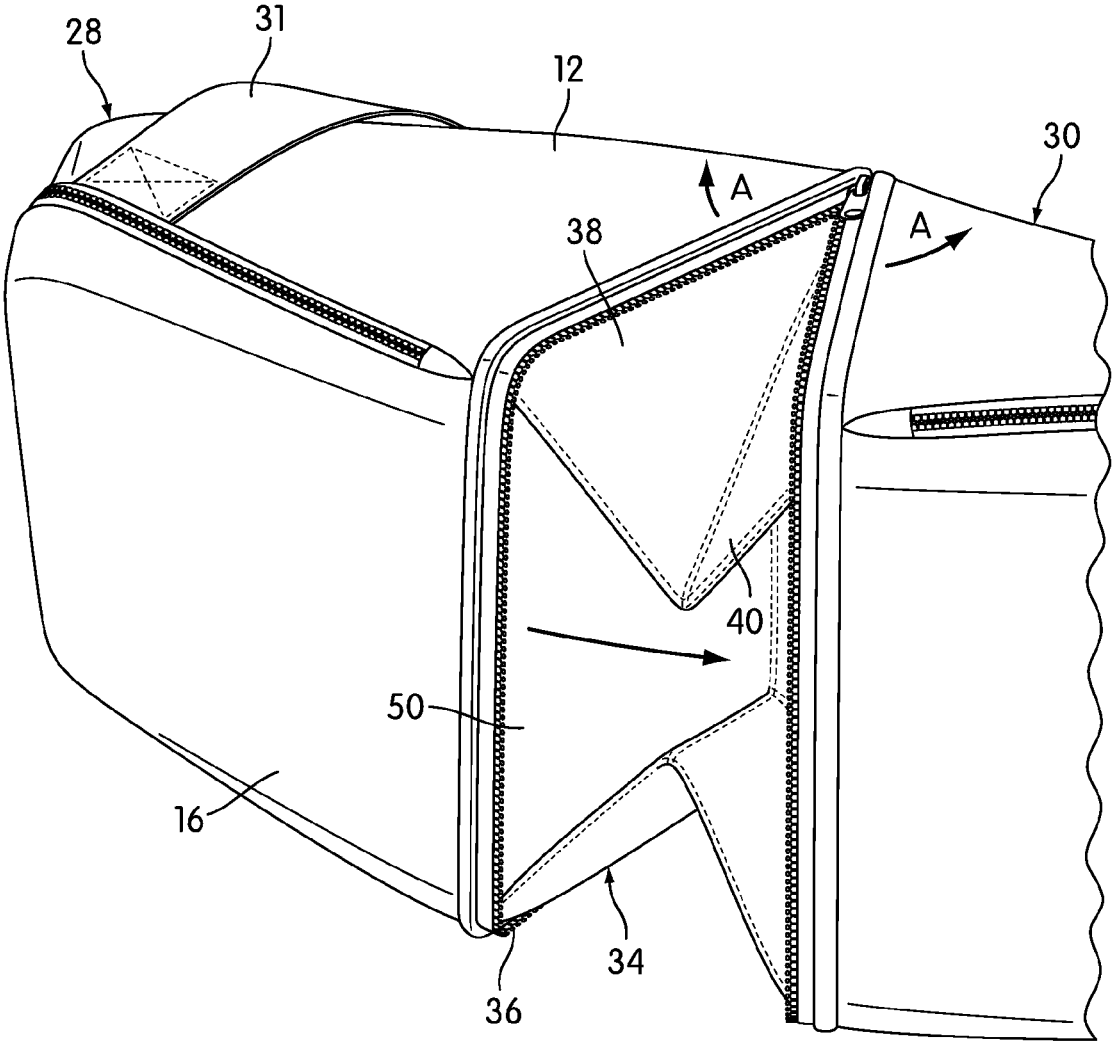
FIGS. 3 and 4 are successive partial perspective views of the bottom of the bag, similar to the view of FIG. 2, illustrating the process of reconfiguring the central expanding section of the bag, thereby changing the shape and increasing the volume of the bag.
Figure 4:
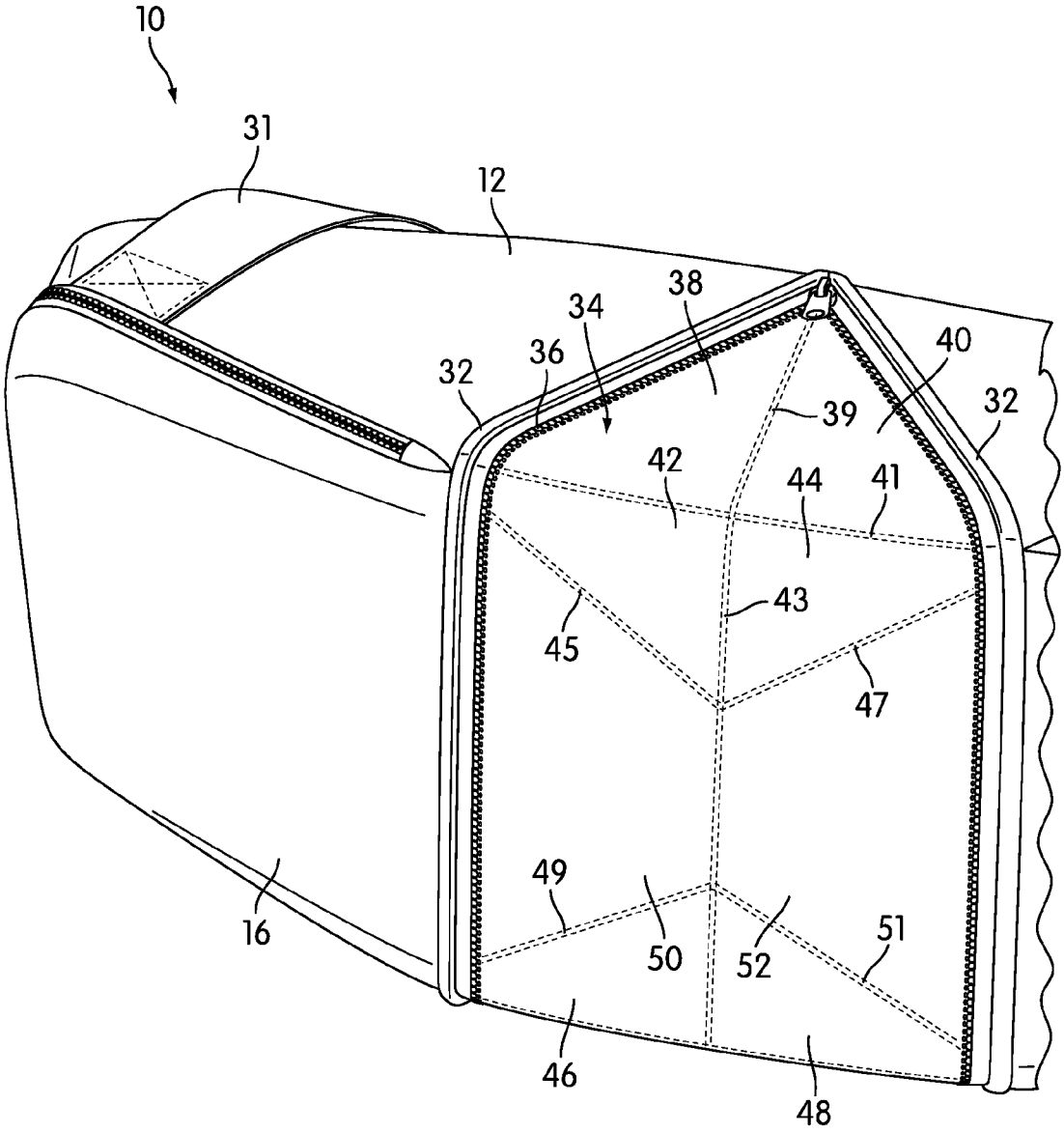

FIGS. 3 and 4 are partial perspective views of the bag 10, similar to the view of FIG. 2, illustrating the process of expanding the expanding section 34 of the bag 10. In the view of FIG. 3, the zipper 36 has been fully opened relative to the closed and concealed position of FIG. 2, and the two portions 28, 30 of the bag are moved in the direction indicated by the arrows A, changing the angular position of the two portions 28, 30 with respect to one another and allowing the expanding section 34 to expand into the space created by the angular displacement of the two portions 28, 30. In essence, the center portion of the top panel 18 acts as a hinge, about which the two portions 28, 30 move.

The expanding section 34 may be constructed in any number of ways. In some embodiments, the expanding section 34 may comprise loose fabric or other flexible material (e.g., one of the plastics or rubbers described above) that acts as gusset material to connect the two portions 28, 30. That loose fabric or material need not have any particular fold lines or creases, and it need not necessarily have any particular degree of stiffness or reinforcement.

However, it may be advantageous if the expanding section 34 is made of at least somewhat rigid panels that have fold lines or creases in predefined positions. Fold lines or creases in predefined positions allow the expanding section 34 to fold neatly when in the first, stored condition and to move relatively predictably between its first configuration and a second, fully expanded configuration that will be described below in more detail. The rigidity of the panels may also help to protect the contents of the bag 10.

The term "flexible material" will be used in this description to refer generally to both types of materials described above—i.e., to materials that are flexible across their entire area, and to rigid or semirigid panels that are only selectively or locally flexible, for example, along designated fold lines in predefined positions.

When fold lines in predefined positions are present in the expanding section 34, they may be created in a number of ways. For example, if the expanding section 34 is made of multiple plies of fabric or other flexible material, then reinforcing plates may be secured between the plies, and the fold lines may then comprise unreinforced areas of the fabric. The reinforcing plates may comprise, for example 1-2 mm high density polyethylene (HDPE), polypropylene, or polycarbonate sheets.

Alternatively, if the bag 10 is made of a plastic or rubber, such as a thermoplastic elastomer, it may include reinforcing plates, similar to those above, that are adhesively bonded, thermally fused, injection molded, or otherwise connected to the elastomer. The fold lines in that case would be the unreinforced sections of the material between adjacent reinforcing plates.

Instead of adding reinforcing plates to a foam, plastic, or rubber to create fold lines, fold lines may be created by selectively thinning portions of a thicker sheet of material where fold lines are desired. Alternatively, the entire expanding section 34 could be injection molded and hinges could be provided where required. For example, if the bag 10 is made of EVA foam, the thickness of the EVA foam over much of the bag may be about 3 mm. Fold lines would be created by thinning the foam or plastic along specific lines, for example, to a thickness of about 1.5 mm. This may also be done, for example, by injection molding a material such as a thermoplastic urethane with thicker and thinner portions. The thinned portions essentially act as living hinges between adjacent thicker sections of the foam or plastic.

FIGS. 3 and 4 illustrate an embodiment in which fold lines are provided in predefined positions, and the material of which the expanding section 34 is made is relatively stiff or reinforced in other places. Specifically, in FIGS. 3 and 4, dotted lines indicate the borders of reinforcing plates or thickened sections of material, while the unreinforced or thinner space between adjacent reinforced or thickened sections defines the fold lines themselves. As can be seen in FIG. 4, the expanding section 34 includes two triangular reinforced sections 38, 40 along each sidewall 12. (The other side of the bag 10, not visible in FIG. 4, may be assumed to be a mirror image of the side that is shown.) Along the bottom 16, the expanding section 34 includes four generally triangular reinforced sections 42, 44, 46, 48 and two generally trapezoidal reinforced sections. Fold lines 39, 41, 43, 45, 47, 49, 51 extend between adjacent sections. When expanded, the expanding section 34 forms a wedge- or sector-shaped section of the bottom 16 and sidewalls 12 of the bag 10. If the expanding section 34 is made of an elastomeric material with some degree of resilience, the natural resilience of the material may urge the expanding section 34 open, toward the position illustrated in FIG. 4.

Figure 14:
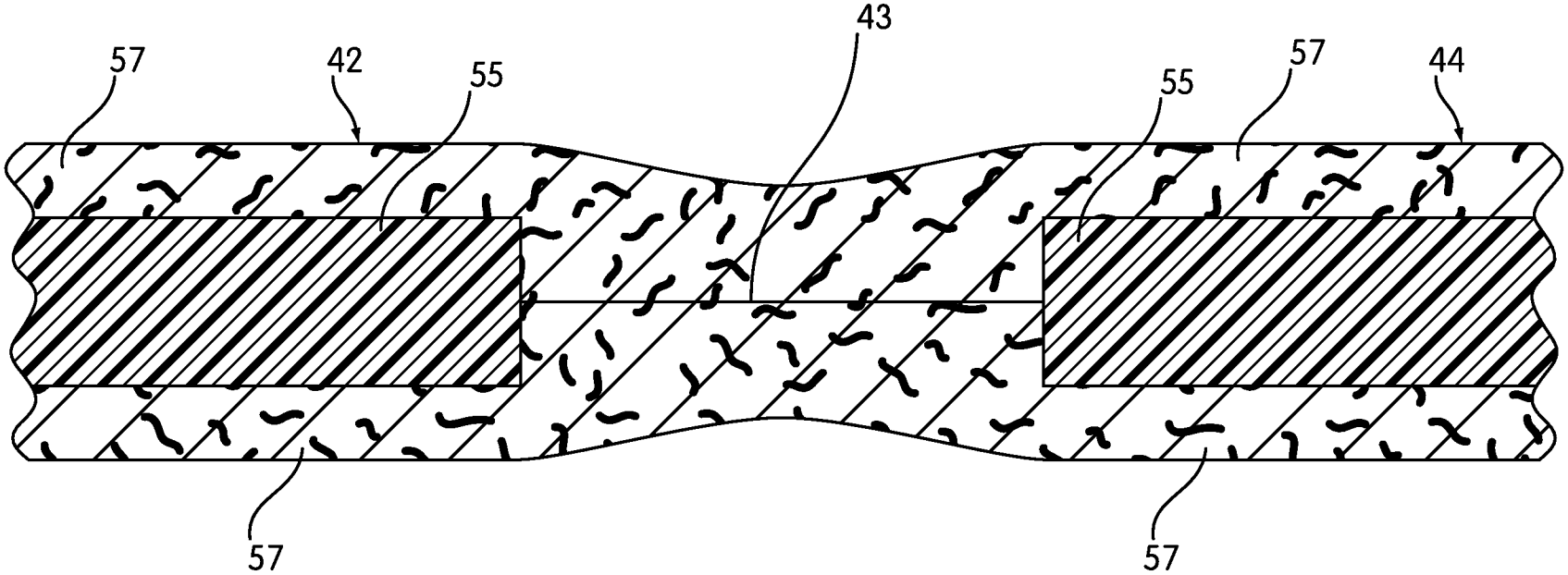

FIG. 14 is a sectional view illustrating two adjacent reinforced sections 42, 44, with reinforcing plates 55 between two layers of fabric 57. The fold line 43 is unreinforced.

Figure 5:
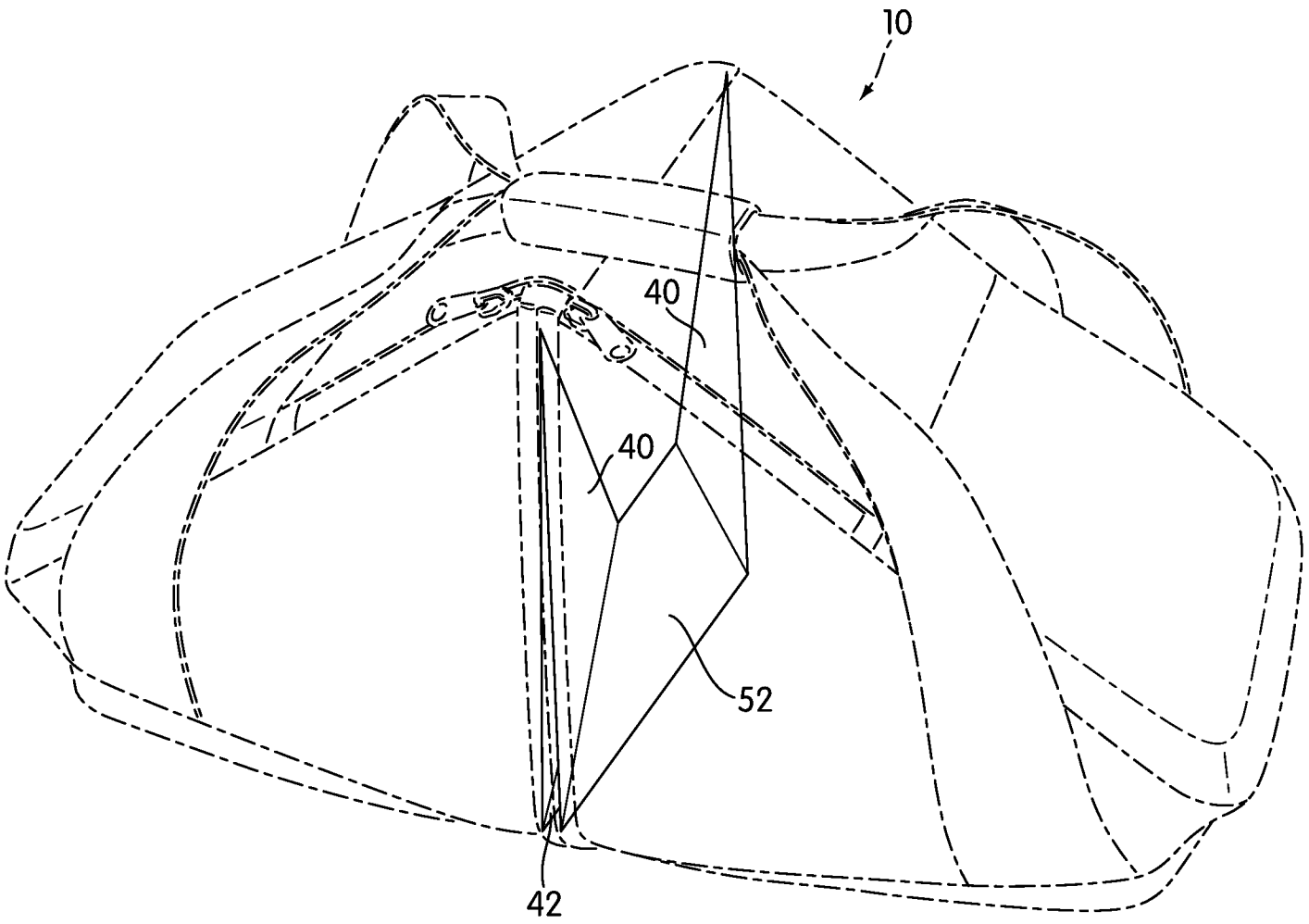
FIG. 5 is a perspective view of the bag in phantom, illustrating the internal arrangement of the bag in the position shown in FIG. 1.

FIG. 5 is a perspective view of the bag 10 in phantom, illustrating the interior of the bag 10 when it is in the first, stored configuration shown in FIG. 1. Because the expanding section 34 is reinforced or, alternatively, has enough rigidity to hold its own shape, the reinforced sections 38, 40, 42, 44, 46, 48, 50, 52 project inwardly when the expanding section 34 is in its first, stored configuration. One advantage of this configuration is that the sections 38, 40, 42, 44, 46, 48, 50, 52 act to at least partially divide the storage volume of the bag 10 when they are stored. That division may provide at least a partial barrier to prevent stored items from sliding the length of the bag 10, and may provide an inherent divider to compartmentalize the bag 10. Of course, this division need not be present in all embodiments.

Figure 6:
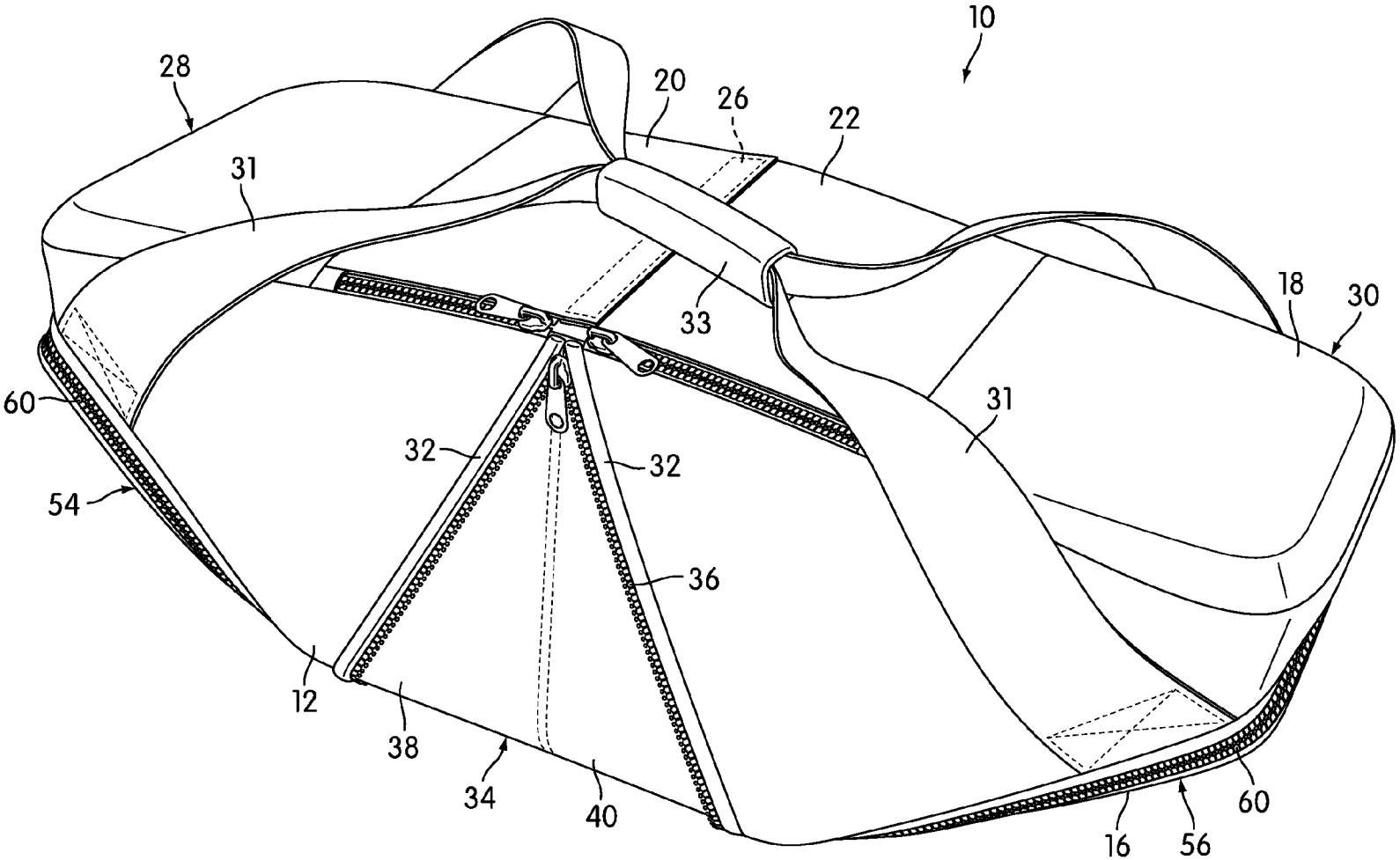
FIG. 6 is a perspective view of the bag with the central section of the bag reconfigured, following the process of FIGS. 3 and 4.

FIG. 6 is a perspective view of the bag 10 with the expanding section 34 fully expanded. The expansion of the expanding section 34 causes the left and right portions 28, 30 of the bag 10 to pivot outward and upward. This causes the top 18 of the bag 10 to flatten. Additionally, because the first and second portions 28, 30 of the bag 10 are angled upwardly with respect to their prior positions, in the second configuration of FIG. 6, the portion of the bottom 16 defined by the expanding section 34 and the area immediately around it are flat, while the bottom 16 slopes upwardly toward the left and right ends. Thus, the configuration or shape of the bag 10 changes when the expanding section 34 is deployed. As shown in FIG. 6, as deployed or expanded, the expanding section 34 defines a wedge- or sector-shaped section of the sidewalls and bottom of the bag 10.

A bag according to some embodiments of the invention may have only a central expanding section 34 (although that expanding section need not be in the center of the bag, as it is in the illustrated embodiment). However, in some embodiments, other expanding sections may be included in order to increase the ability to reconfigure the bag 10 for any desired task.

Specifically, the bag 10 has left and right bottom expanding sections, generally indicated at 54 and 56. The two sections are identical; therefore, description of one section 54, 56 should be construed to apply to the other section 54, 56. Each section has a panel 58, sometimes referred to as a wing panel, that forms part of the bottom 16 of the bag 10. (The panels are best seen in the bottom views of FIGS. 2 and 3.) The panels 58 are hingedly connected to the bag 10 so that they can rotate downwardly.

In a first, stored configuration, shown in FIGS. 1-6, the bottom expanding sections 54, 56 and their respective panels 58 are held in place by a pair of zippers 60. Each of the zippers 60 traverses a U-shaped path around the perimeter of the bottom 16 of the bag 10, and together, the two zippers 60 cover almost the entire periphery of the bottom 16 of the bag 10, except for that portion of the bottom 16 that hingedly connects the two panels 58. In some embodiments, the zippers 60 may be concealed by piping. In other embodiments, fasteners other than zippers may be used.

Figure 7:
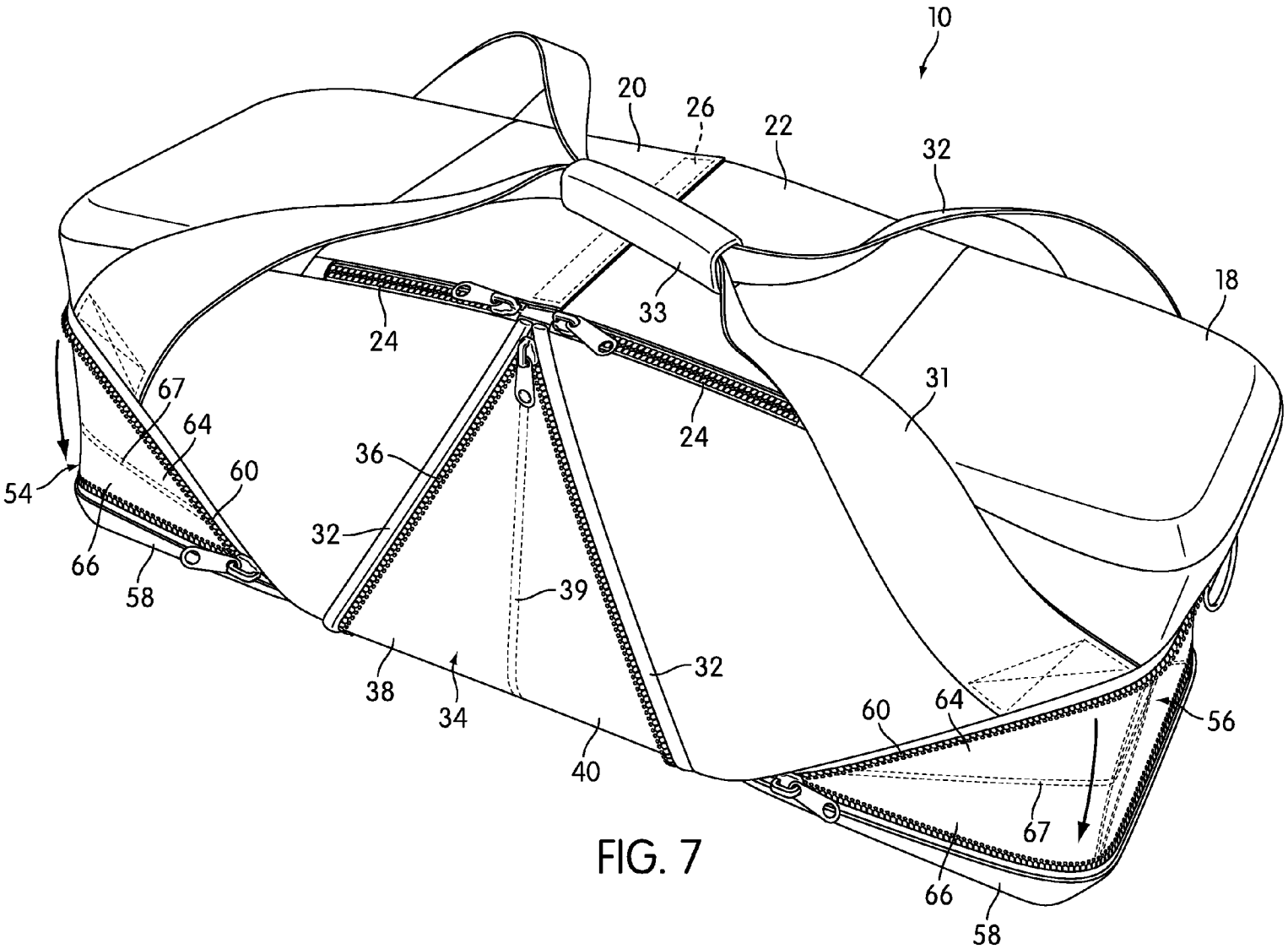
FIG. 7 is a perspective view of the bag with the center and end sections reconfigured and expanded to provide additional space.
Figure 8:
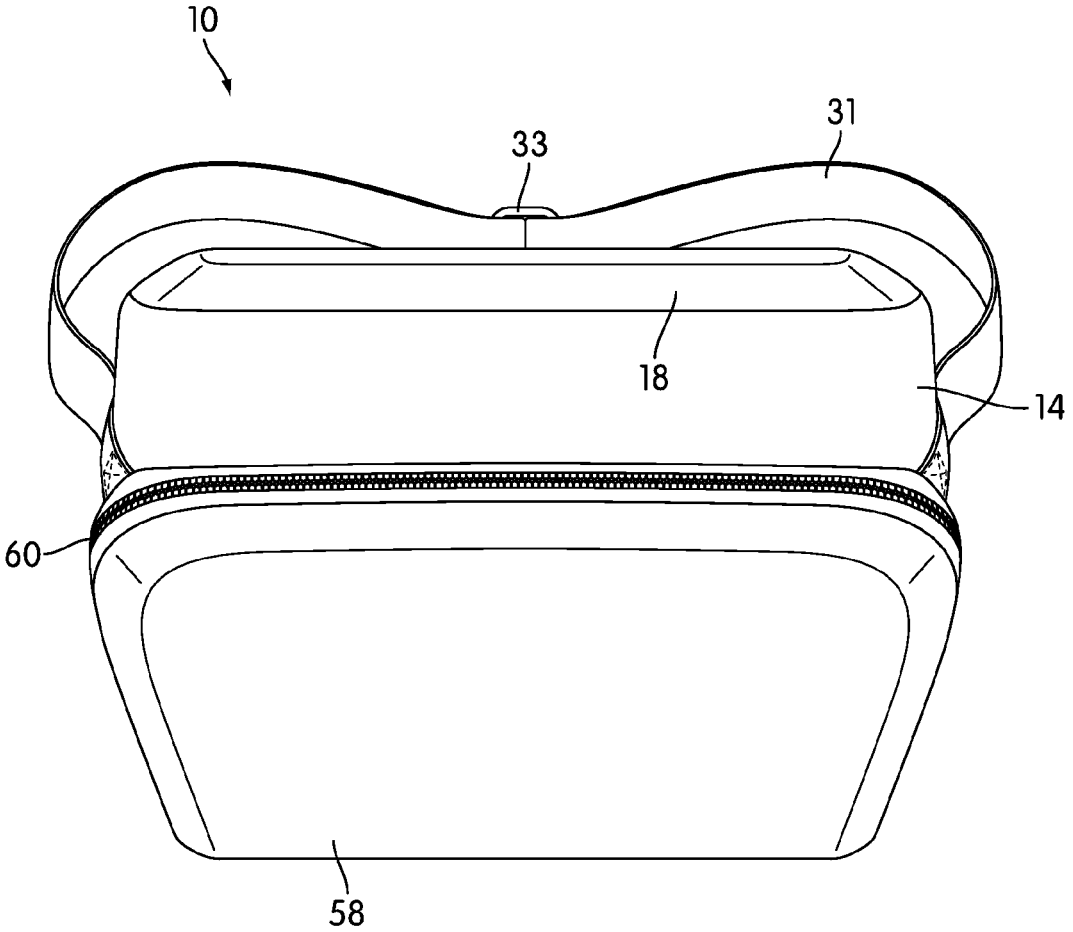
FIGS. 8-10 are successive end elevational views of the bag illustrating the process of reconfiguring an end section of the bag, thereby changing its shape and increasing its storage volume.
Figure 9:
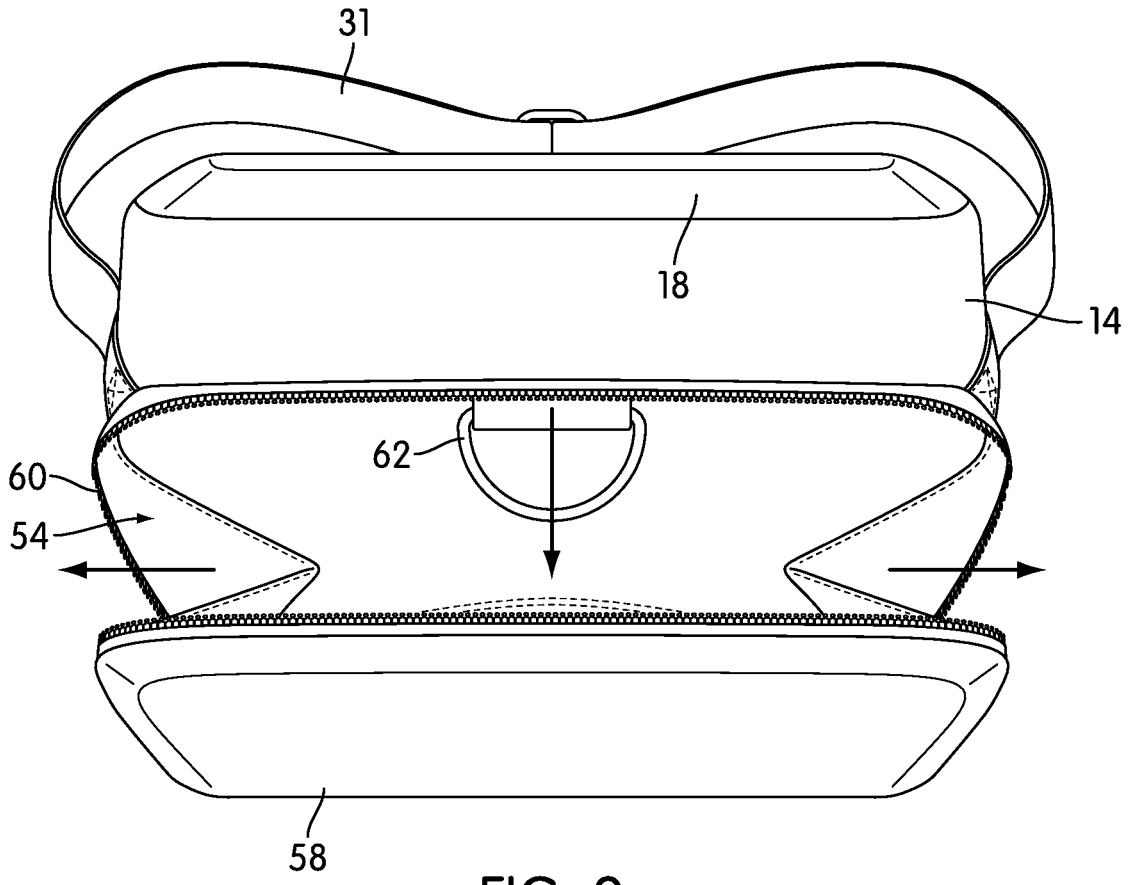
Figure 10:
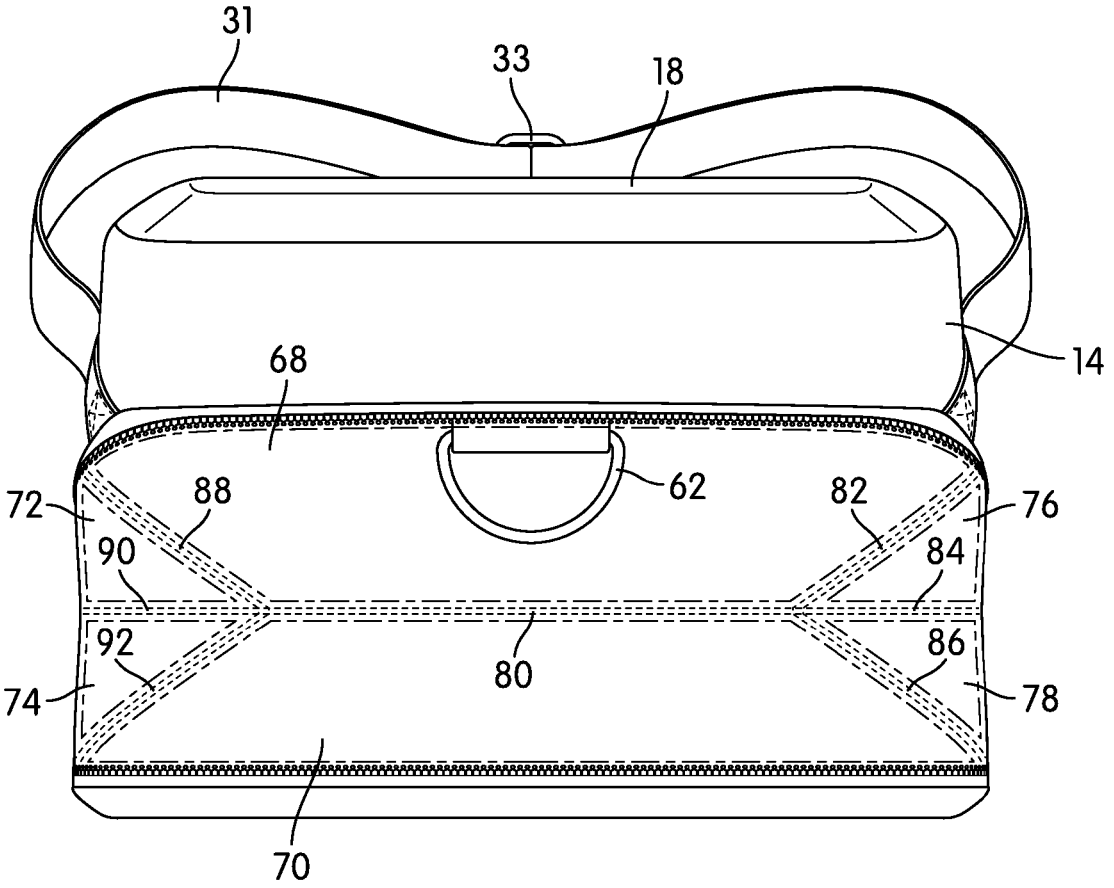

FIG. 7 is a perspective view of the bag 10 illustrating the deployment of the bottom expanding sections 54, 56 into their second, expanded configuration. As shown, if one unzips the zippers 60, the panels 58 can be pulled or allowed to move downward, and are thus displaced angularly from their stored positions, allowing the bottom expanding sections 54, 56 to expand. (As was noted above, if elastomeric or resilient materials are used for the expanding sections 54, 56, they may be biased to return to expanded configurations when the zippers 60 or other fasteners are released.) FIGS. 8-10 are successive end elevational views of one end of the bag 10, illustrating the bottom expanding section opening sequence from that perspective.

In the view of FIG. 8, the bag is in the configuration shown in FIG. 6, and with the center expanding section 34 expanded, the panel 58 of the bottom expanding section 54, 56 is angled upwardly. When the zipper 60 is released, as shown in the view of FIG. 9, the bottom expanding section 54 is permitted to expand into the fully expanded second configuration shown in FIG. 10. Fully expanded, each bottom expansion section 54, 56 forms a wedge-shaped portion of the sidewalls 12 and endwalls 14 of the bag 10.

As shown in FIGS. 8-10, the expansion of the expanding section 54 also exposes a D-ring 62 that is attached to the seam just below the zipper 60. The D-ring 62 provides a point of attachment for a long shoulder strap (not shown in the figures). In other embodiments, the D-ring 62 may be located so that the bottom expanding sections 54, 56 need not be opened and expanded to access it.

Like the center expanding section 34, the bottom expanding sections 54, 56 may be made in any of a variety of ways, including all of the ways described above. The configuration of the bottom expanding sections 54, 56 in the illustrated embodiment is very similar to the configuration of the center expanding section 34, with rigid or semirigid panels that have fold lines in predefined positions.

Specifically, as can be seen in FIGS. 7 and 10, the expanding section 54 includes two generally triangular reinforced or thickened sections 64, 66 with one fold line or thinned section 67 between them along each sidewall 12. Along the endwalls 14, the expanding sections 54, 56 include two large, generally trapezoidal reinforced or thickened sections 68, 70 opposite one another and four smaller generally triangular reinforced or thickened sections 72, 74, 76, 78. Fold lines 80, 82, 84, 86, 88, 90, 92 extend between the adjacent sections 68, 70, 72, 74, 76, 78.

Figure 11:
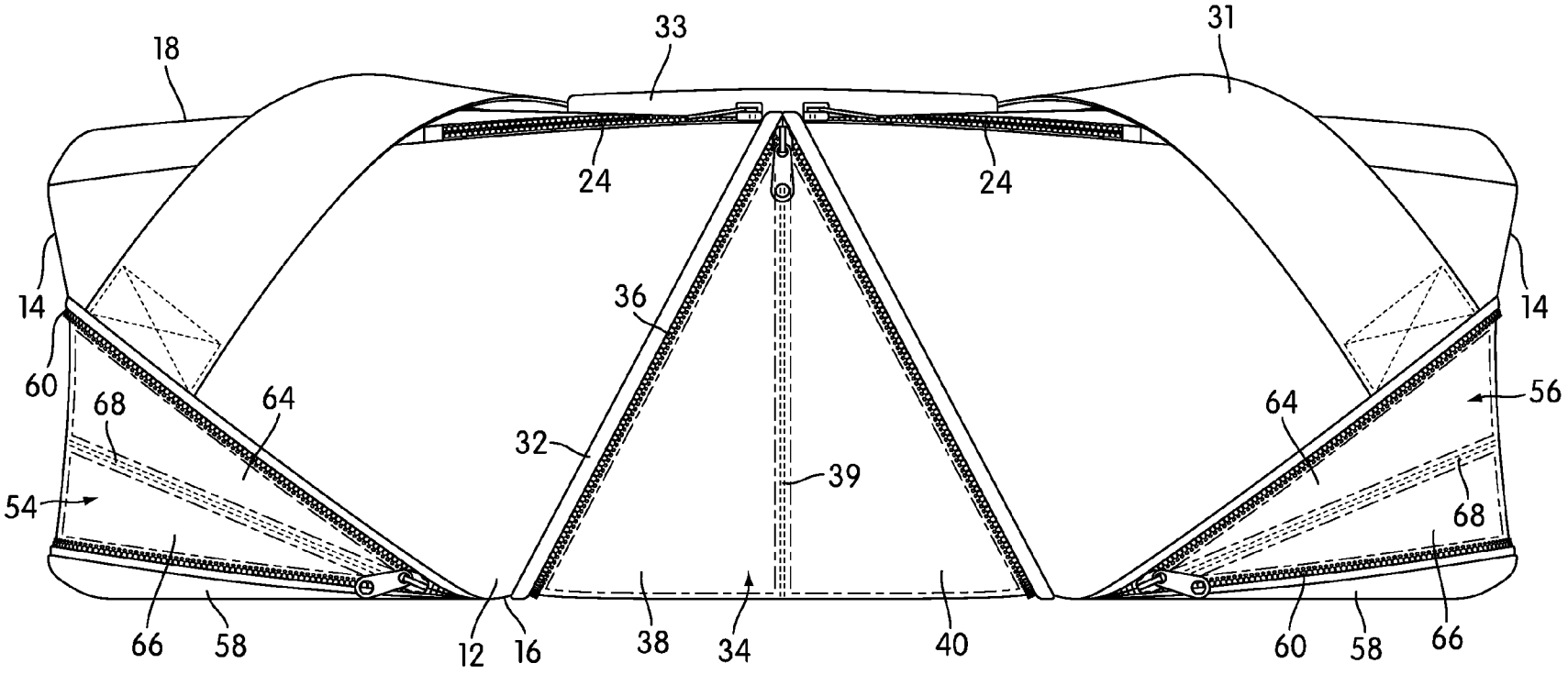
FIG. 11 is a side elevational view of the bag with both central section and end sections reconfigured and expanded for additional space.
Figure 12:
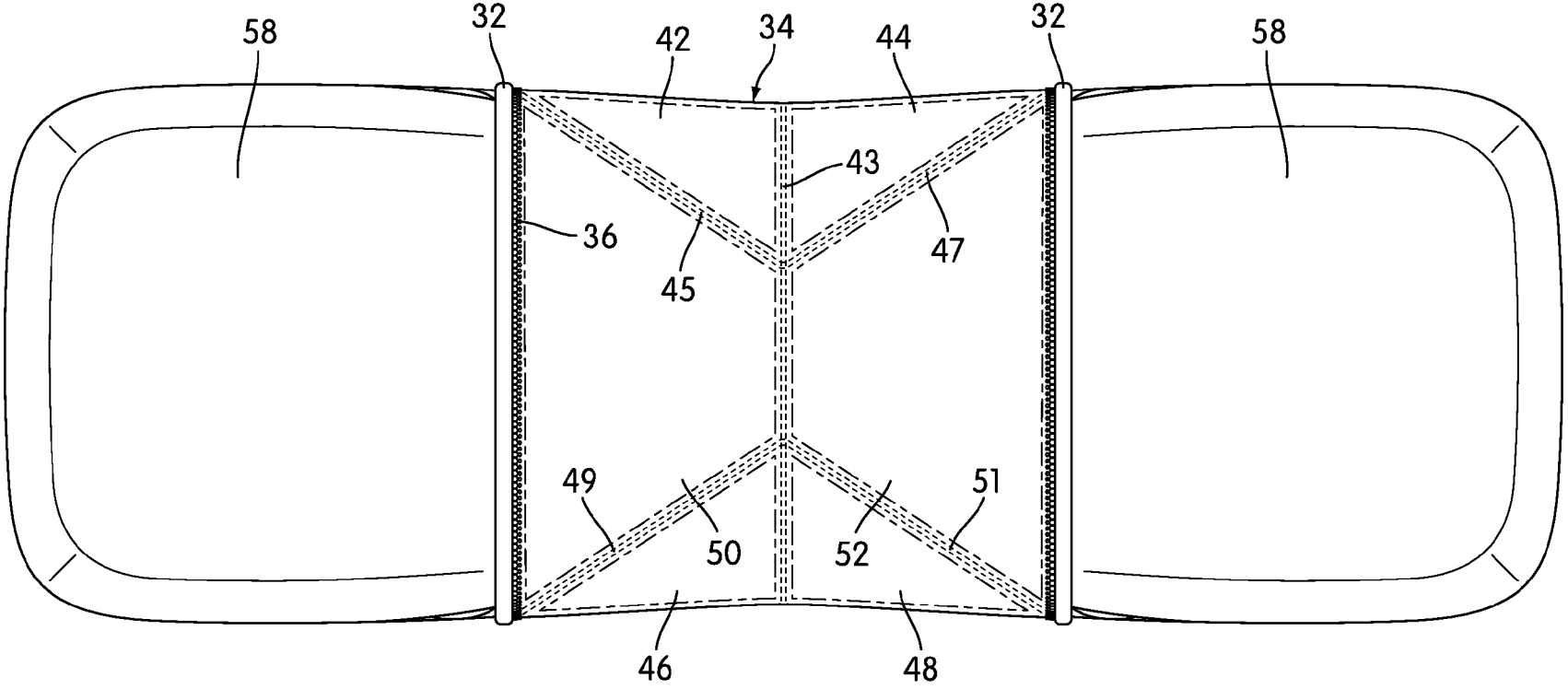
FIG. 12 is a bottom plan view of the bag with the central and end sections reconfigured and expanded.

FIG. 11 is a side elevational view of the bag 10 with the center expanding section 34 and both bottom expanding sections 54, 56 expanded. FIG. 12 is a bottom plan view of the bag 10 fully expanded. Whereas the shape of the bag 10 in FIG. 1 is generally that of a pentagonal prism, the shape of the bag 10 with all of the expanding sections 34, 56, 58 expanded is generally that of a rectangular prism, as shown in FIGS. 7 and 11. Moreover, the user can choose which, if any, of the sections 34, 56, 58 to expand at any one time.

The principles embodied in the bag 10 may be applied to different types and forms of bags, and bags according to embodiments of the invention need not have the same shape, shapes, or range of configurations as the bag 10. Additionally, as those of skill in the art will realize, other features may be added or changed.

Figure 13:
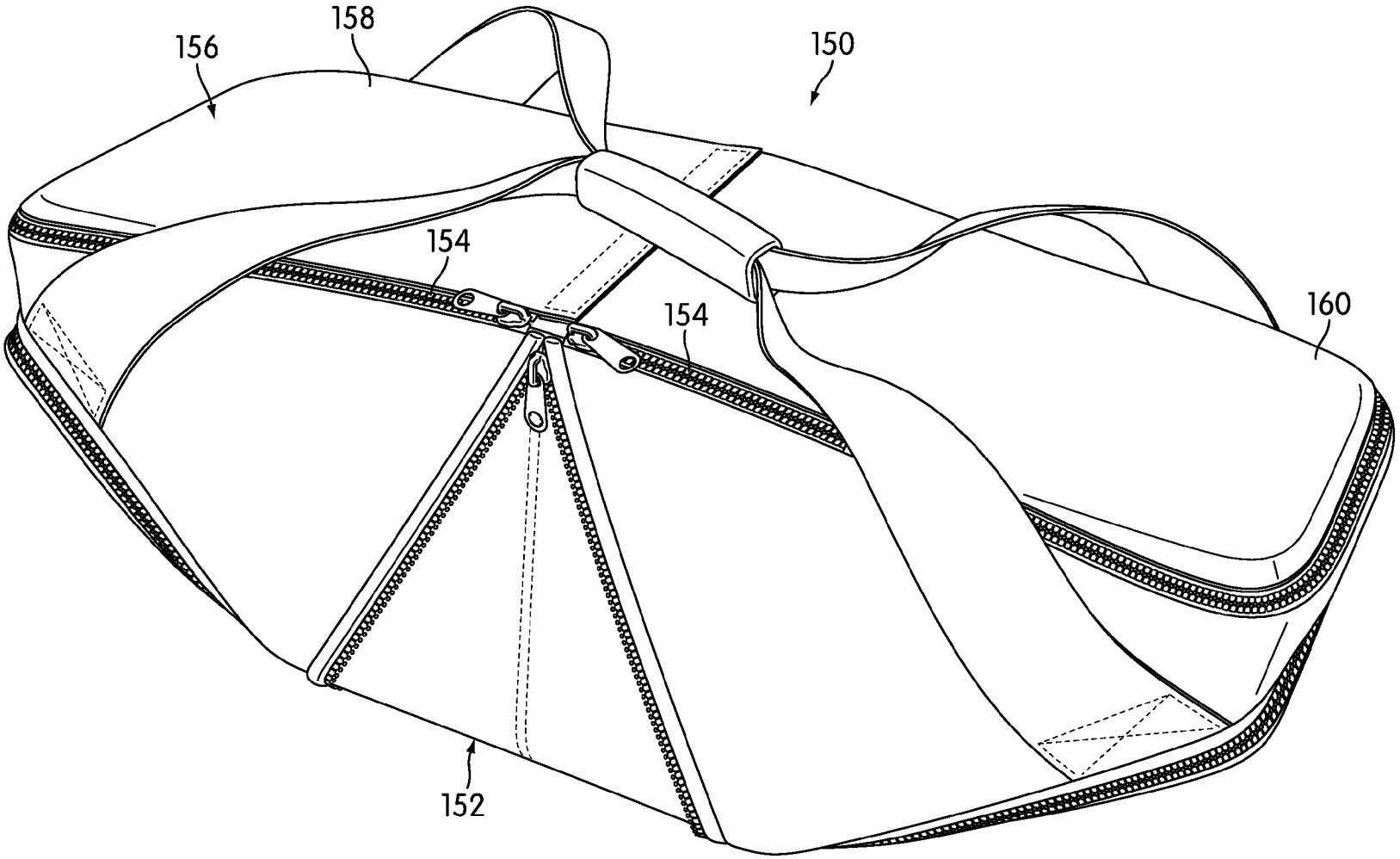
FIG. 13 is a perspective view of another embodiment of a bag, illustrating an alternate zipper configuration for the top flaps.

As one example, FIG. 13 is a perspective view of a bag 150 according to another embodiment of the invention, shown with its expanding center section 152 fully open. The bag 150 is similar to the bag 10 of FIGS. 1-12, with the exception that in the bag 150, zippers 154 traverse substantially the entirety of the periphery of the top 156, thus allowing the opening panels 158, 160 to open more broadly, allowing better access to the storage volume of the bag 10 than with the bag 10.

While the invention has been described with respect to certain embodiments, the embodiments are intended to be illustrative, rather than limiting. Modifications and changes may be made within the scope of the invention, which is defined by the appended claims.

What is claimed is:

1. A bag, comprising:

first and second portions, each of the first and second portions enclosing a portion of a storage volume of the bag; and an expanding section comprised of a flexible material joining the first and second portions, the expanding section being capable of assuming either of two configurations: (1) a first configuration in which the expanding section is essentially folded or stuffed within the storage volume, and (2) a second configuration in which the expanding section forms a wedge- or sector-shaped section of the sides and bottom of the bag with the widest portion of the expanding section along the bottom of the bag, thereby expanding the storage volume of the bag and altering the angular position of the first and second portions with respect to one another; and left and right bottom expanding sections, each of the left and right bottom expanding sections comprising a wing panel hingedly connected to the bottom of the bag so as to pivot about a generally horizontal axis of rotation and a flexible wing material joining the wing panel with the bottom of the bag such that the wing panel and the flexible wing material together enclose an additional storage volume contiguous with the storage volume of the bag, the bottom expanding sections being capable of assuming either of two configurations: (1) a first configuration in which the flexible wing material is essentially stuffed or folded within the storage volume, and (2) a second configuration in which the flexible wing material forms a wedge- or sector-shaped section of the sides of the bag.

2. The bag of claim 1, further comprising first retaining structure being arranged and adapted to retain the expanding section in its first configuration.

3. The bag of claim 2, wherein the first retaining structure comprises a zipper.

4. The bag of claim 1, further comprising a pair of retaining structures, each of the retaining structures being arranged and adapted to retain one of the bottom expanding sections in its first configuration.

5. The bag of claim 4, wherein each of the retaining structures comprises a zipper.

6. The bag of claim 1, wherein the expanding section is positioned along essentially the horizontal centerline of the bag.

7. The bag of claim 1, wherein the flexible material of the expanding section has one or more fold lines in predefined positions that allow it to fold and unfold in a predefined manner.

8. The bag of claim 7, wherein the flexible material comprises two or more layers of fabric.

9. The bag of claim 8, wherein the flexible material comprises reinforcing plates between layers of fabric.

10. The bag of claim 9, wherein the one or more fold lines in predefined positions comprise unreinforced layers of fabric between adjacent reinforcing plates.

11. The bag of claim 9, wherein the flexible material in its first configuration at least partially subdivides the volume of space in the interior of the bag.

12. The bag of claim 1, wherein the first and second portions define a top panel, the top panel having a closeable opening that permits access to the storage volume of the bag.

13. The bag of claim 1, further comprising:

a front panel, a back panel, a left side panel and a right side panel connected to the bottom to define the first and second portions and the storage volume of the bag; and a top panel connected to the front panel, the back panel, the left side panel, and the right side panel to cover and enclose the storage volume of the bag.

14. The bag of claim 13, wherein the front and back panels are generally pentagonal with the expanding section in its first configuration and the bottom expanding sections in their first configurations.

15. The bag of claim 14, wherein the front and back panels are generally rectangular with the expanding section in its second configuration and the bottom expanding sections in their second configurations.

16. A bag, comprising:

a bottom;

a pair of sidewalls;

a pair of endwalls;

a top connected to the sidewalls and endwalls so as to cover and enclose the bag, the top having a closeable opening;

an expanding section extending from the top of one of the pair of sidewalls, across the bottom and to the top of the other of the pair of sidewalls and dividing the pair of sidewalls and the bottom, the expanding section being comprised of a flexible material that joins the divided panels and being capable of assuming either of two configurations: (1) a first configuration in which the expanding section is essentially folded or stuffed within the storage volume, and (2) a second configuration in which the expanding section forms a wedge- or sector-shaped section in the pair of sidewalls and the bottom; and left and right bottom expanding sections, each of the left and right bottom expanding sections including a wing panel hingedly connected to the bottom so as to pivot about a generally horizontal axis of rotation and a flexible wing material joining the wing panel with the bottom of the bag such that the wing panel and the flexible wing material together enclose an additional storage volume contiguous with the storage volume of the bag, wherein the bottom expanding sections are capable of assuming either of two configurations: (1) a first configuration in which the wing panel is essentially flush with the bottom of the bag and the flexible wing material is essentially stuffed or folded within the storage volume and 2 a second configuration in which the flexible wing material forms a wedge- or sector-shaped section of the pair of sidewalls.

17. The bag of claim 16, wherein the bag has the general shape of a rectangular prism when the expanding section is in its second configuration and the bottom expanding sections are in their second configuration.

18. The bag of claim 16, wherein the bag has the general shape of a pentagonal prism when the expanding section is in the first configuration.

* * * * *